US006454428B1

(12) United States Patent
Bruzon

(10) Patent No.: US 6,454,428 B1
(45) Date of Patent: Sep. 24, 2002

(54) LIGHTED EXTENSION ATTACHMENT FOR TOOLS

(76) Inventor: Ruben Bruzon, 30 S Montgomery St. 1st Fl., Valley Stream, NY (US) 11580

( * ) Notice: Subject to any disclaimer, the term of this patent is extended or adjusted under 35 U.S.C. 154(b) by 0 days.

(21) Appl. No.: 09/770,435

(22) Filed: Jan. 26, 2001

(51) Int. Cl.[7] ..... F21V 33/00

(52) U.S. Cl. ..... 362/119; 362/120; 362/253; 362/431; 362/410

(58) Field of Search ..... 362/119, 120, 362/109, 253, 410, 431

(56) References Cited

U.S. PATENT DOCUMENTS 2,588,288 A * 3/1952 Pohanka ..... 362/119
3,924,115 A 12/1975 Hampton et al.
4,586,741 A 5/1986 Muti
5,313,376 A * 5/1994 McIntosh ..... 362/119
5,502,625 A 3/1996 Peng
5,510,962 A * 4/1996 Hsiao ..... 362/120
5,611,615 A * 3/1997 Jang ..... 362/119
5,720,542 A 2/1998 Birge, Jr. et al.
5,797,670 A * 8/1998 Snoke ..... 262/119
5,860,728 A 1/1999 Maglica
D408,091 S 4/1999 Joyner et al.
5,899,554 A * 5/1999 Hsu ..... 362/119
5,951,142 A * 9/1999 Wang et al. ..... 362/119
6,116,747 A * 9/2000 Grawemeyer et al. ..... 362/120
6,135,607 A * 10/2000 Cook ..... 362/120

* cited by examiner

*Primary Examiner*—Thomas M. Sember

(57) ABSTRACT

A lighted extension attachment for tools for illuminating hard-to-reach areas while working with various tool members. The lighted extension attachment for tools includes a base member having a bore centrally-disposed therethrough. An elongate support member has a bottom end and a top end portion and a bore extending therein and is removably supported in the bore of the base member. A light-emitting assembly includes a light socket member being fastenably attached to the elongate support member. A tool members is detachably attached to the elongate support member.

10 Claims, 2 Drawing Sheets

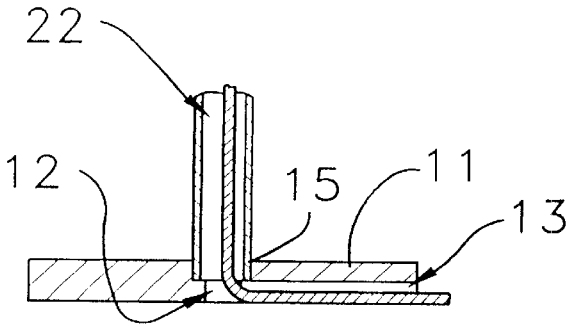
FIG. 3
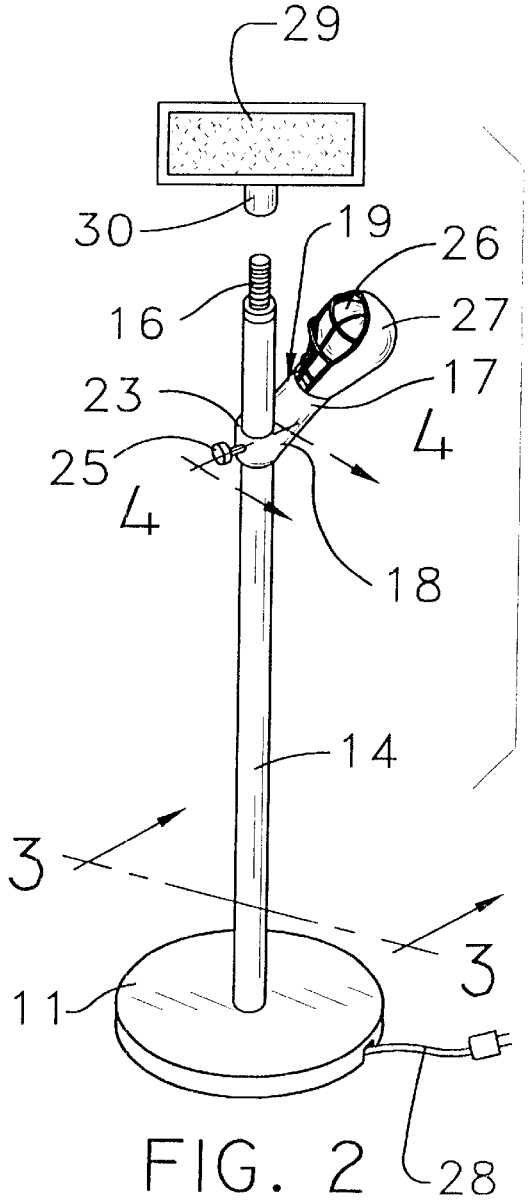
FIG. 2
FIG. 4
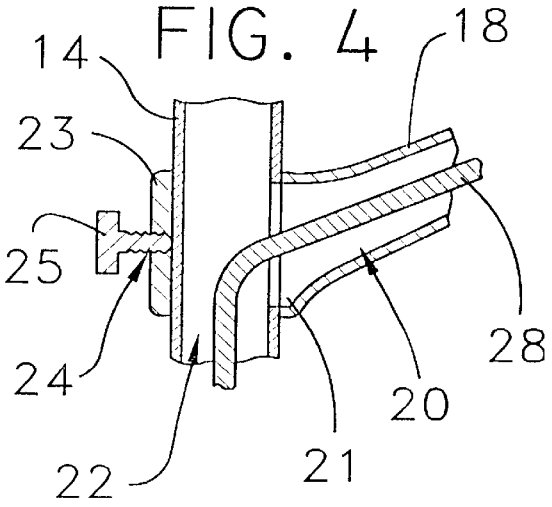

LIGHTED EXTENSION ATTACHMENT FOR TOOLS

BACKGROUND OF THE INVENTION

1. Field of the Invention

The present invention relates to a tool extension attachment and more particularly pertains to a new lighted extension attachment for tools for illuminating hard-to-reach areas while working with various tool members.

2. Description of the Prior Art

The use of a tool extension attachment is known in the prior art. More specifically, a tool extension attachment heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,586,741; 5,860,728; 5,720,542; 3,924,115: 5,502,625; and U.S. Pat. No. Des. 408,091.

While these devices fulfill their respective, particular objectives and requirements, the aforementioned patents do not disclose a new lighted extension attachment for tools. The inventive device includes a base member having a bore centrally-disposed therethrough; and also includes an elongate support member having a bottom end and a top end portion and a bore extending therein and being removably supported in the bore of the base member; and further includes a light-emitting assembly including a light socket member being fastenably attached to the elongate support member; and also includes tool members being detachably attached to the elongate support member.

In these respects, the lighted extension attachment for tools according to the present invention substantially departs from the conventional concepts and designs of the prior art, and in so doing provides an apparatus primarily developed for the purpose of illuminating hard-to-reach areas while working with various tool members.

SUMMARY OF THE INVENTION

In view of the foregoing disadvantages inherent in the known types of tool extension attachment now present in the prior art, the present invention provides a new lighted extension attachment for tools construction wherein the same can be utilized for illuminating hard-to-reach areas while working with various tool members.

The general purpose of the present invention, which will be described subsequently in greater detail, is to provide a new lighted extension attachment for tools which has many of the advantages of the tool extension attachment mentioned heretofore and many novel features that result in a new lighted extension attachment for tools which is not anticipated, rendered obvious, suggested, or even implied by any of the prior art tool extension attachment, either alone or in any combination thereof.

To attain this, the present invention generally comprises a base member having a bore centrally-disposed therethrough; and also includes an elongate support member having a bottom end and a top end portion and a bore extending therein and being removably supported in the bore of the base member; and further includes a light-emitting assembly including a light socket member being fastenably attached to the elongate support member; and also includes tool members being detachably attached to the elongate support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be Utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define: the invention of the application, which is measured by the claims, nor is it intended to be limiting as to the scope of the invention in any way.

It is therefore an object of the present invention to provide a new lighted extension attachment for tools which has many of the advantages of the tool extension attachment mentioned heretofore and many novel features that result in a new lighted extension attachment for tools which is not anticipated, rendered obvious, suggested, or even implied by any of the prior art tool extension attachment, either alone or in any combination thereof.

It is another object of the present invention to provide a new lighted extension attachment for tools which may be easily and efficiently manufactured and marketed.

It is a further object of the present invention to provide a new lighted extension attachment for tools which is of a durable and reliable construction.

An even further object of the present invention is to provide a new lighted extension attachment for tools which is susceptible of a low cost of manufacture with regard to both materials and labor, and which accordingly is then susceptible of low prices of sale to the consuming public, thereby making such lighted extension attachment for tools economically available to the buying public.

Still yet another object of the present invention is to provide a new lighted extension attachment for tools which provides in the apparatuses and methods of the prior art some of the advantages thereof, while simultaneously overcoming some of the disadvantages normally associated therewith.

Still another object of the present invention is to provide a new lighted extension attachment for tools for illuminating hard-to-reach areas while working with various tool members.

Yet another object of the present invention is to provide a new lighted extension attachment for tools which includes a base member having a bore centrally-disposed therethrough; and also includes an elongate support member having a bottom end and a top end portion and a bore extending therein and being removably supported in the bore of the base member; and further includes a light-emitting assembly including a light socket member being fastenably attached to the elongate support member; and also includes tool members being detachably attached to the elongate support member.

Still yet another object of the present invention is to provide a new lighted extension attachment for tools that is easy and convenient to use.

Even still another object of the present invention is to provide a new lighted extension attachment for tools that allows the user to reach and see into certain areas with the tool members so that the user knows what he/she is doing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is another exploded view of the present invention.

FIG. 3 is a cross-sectional view of the base member and a partial cross-sectional view of the elongate support member of the present invention.

FIG. 4 is a partial cross-sectional view of the elongate support member and the light-emitting bracket member of the present invention.

DESCRIPTION OF THE PREFERRED EMBODIMENT

Figure 1:
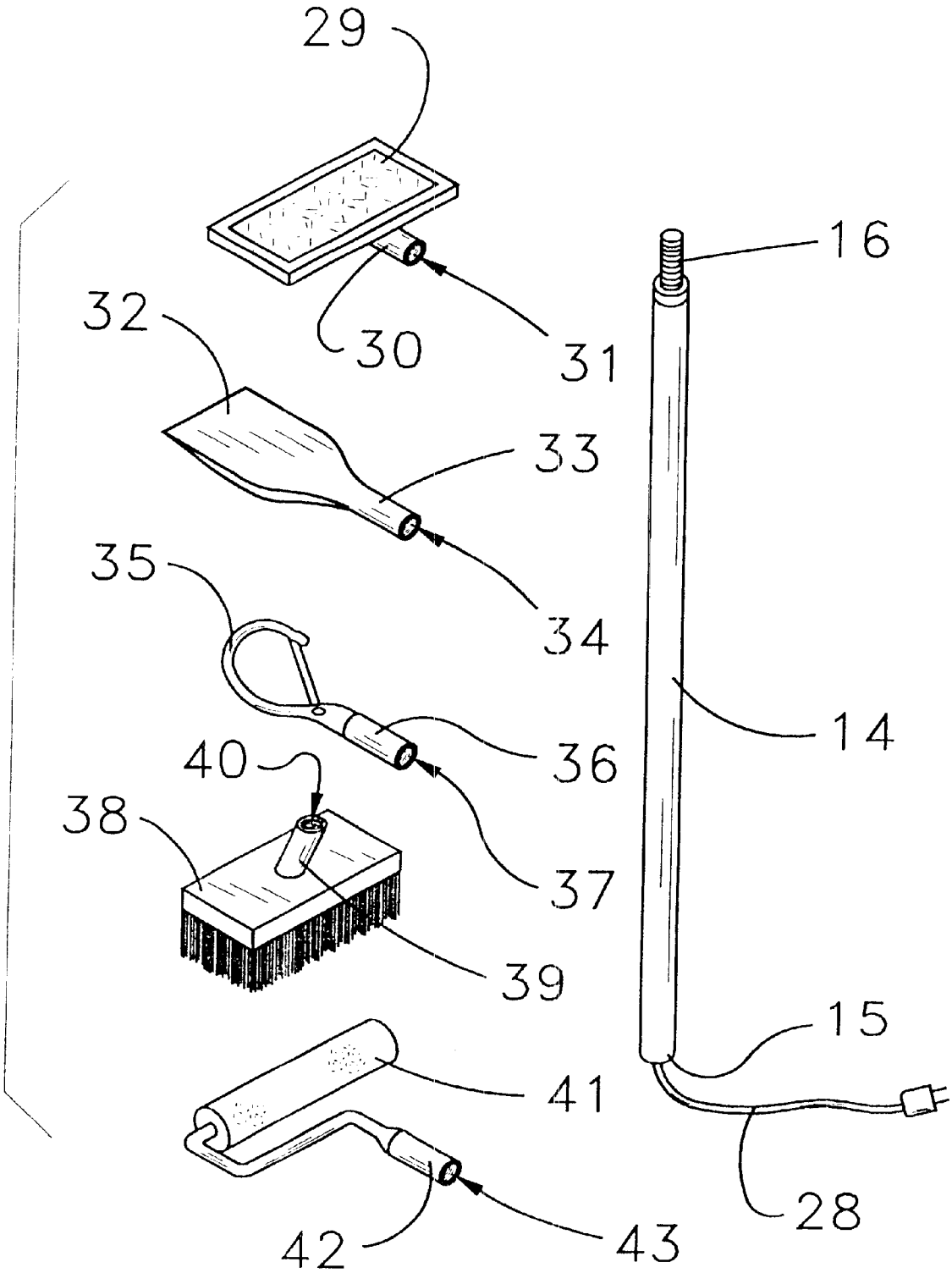
FIG. 1 is an exploded perspective view of a new lighted extension attachment for tools according to the present invention.

With reference now to the drawings, and in particular to FIGS. 1 through 4 thereof, a new lighted extension attachment for tools embodying the principles and concepts of the present invention and generally designated by the reference numeral 10 will be described.

As best illustrated in FIGS. 1 through 4, the lighted extension attachment for tools 10 generally comprises a base member 11 having a bore 12 centrally-disposed therethrough. The base member 11 also has an elongate slot 13 extending in a bottom thereof and extending through a side thereof and extending into the bore 12 of the base member 11. An elongate support member 14 has a bottom end 15 and a top end portion 16 and a bore 22 extending therein and is removably supported in the bore 12 of the base member 11. The top end portion 16 of the elongate support member 14 being annular recessed and being threaded. The elongate support member 14 also includes a hole being disposed through a wall and into the bore 22 near the top end portion 16 thereof. The bore 22 of the elongate support member 14 extends from the hole through the bottom end 15 thereof with the elongate support member 14 having a length of approximately 48 inches.

A light-emitting assembly includes a light socket member 17 being fastenably and conventionally attached to the elongate support member 14. The light-emitting assembly also includes a sleeve 23 being removably and fastenably mounted about the elongate support member 14. The light socket member 17 includes an elongate housing 18 having an open first end 19 and an open second end 21 and a bore 20 extending therethrough. The elongate housing 18 is securely and conventionally attached to and angled from the sleeve 23. The light-emitting assembly further includes a fastening member 25 is threaded through a hole 24 of the sleeve 23 and is engagable to the elongate support member 14 for fastening the sleeve 23 to the elongate support member 14. The light-emitting assembly also includes a light-emitting member 26 being removably connected to the light socket member 17 through the open first end 19 and in the bore 20 of the elongate housing 18. The light-emitting assembly further includes a power cord 28 being conventionally connected to the light socket member 17 and being disposed through the bore 22 of the elongate support member 14 and in the elongate slot 13 of the base member 11. The light-emitting assembly also includes a protective cover 27 being conventionally connected to the elongate housing 18 and being disposed about the light-emitting member 26 to prevent breakage of the light-emitting member 26.

Tool members 29, 32, 35, 38, 41 are detachably attached to the elongate support member 14. The tool members 29, 32, 35, 38, 41 include a sander/sponge 29, a putty knife/a scraper 32, a hook 35, a brush 38, and a paint roller 41. Each of the tool members 29, 32, 35, 38, 41 has a shaft 30, 33, 36, 39, 42 which has a bore 31, 34, 37, 40, 43 extending therein through an open end thereof. The shaft 30, 33, 36, 39, 42 is adapted to be removably-threaded upon the threaded top end portion 16 of the elongate support member 14.

In use the user threads the appropriate tool member 29, 32, 35, 38, 41 upon the top end portion 16 of the elongate support member 14, and conventionally turns on the light-emitting member 26, and then uses the tool member 29, 32, 35, 38, 41 for the particular task it is designed for.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted extension attachment for tools comprising:

a base member;

an elongate support member having a bottom end and a top end portion and a bore extending therein, said support member being removably mounted on said base member;

a light-emitting assembly including a light socket member being fastenably attached to said elongate support member; and tool members being detachably attachable to said elongate support member;

wherein said light-emitting assembly includes:

a sleeve being removably and fastenably mounted about said elongate support member;

an elongate housing mounted on said sleeve and having an open first end and an open second end and a bore extending therethrough;

a light-emitting member being removably connected to said light socket member through said open first end and in said bore of said elongate housing;

a power cord being connected to said light socket member and being disposed through said bore of said elongate support member; and a protective cover being connected to said elongate housing and being disposed about said light-emitting member to prevent breakage of said light-emitting member.

2. A lighted extension attachment for tools as described in claim 1, wherein said base member has an elongate slot extending in a bottom thereof and extending through a side thereof and extending into said bore of said base member.

3. A lighted extension attachment for tools as described in claim 1, wherein said top end portion of said elongate support member is annular recessed and is threaded.

4. A lighted extension attachment for tools as described in claim 1, wherein said elongate support member also includes a hole being disposed through a wall and into said bore near said top end portion thereof, said bore of said elongate support member extending from said hole through said bottom end thereof.

5. A lighted extension attachment for tools as described in claim 1, wherein said elongate housing is angled with respect to said sleeve.

6. A lighted extension attachment for tools as described in claim 1, wherein said light-emitting assembly further includes a fastening member being threaded through a hole in said sleeve and being engagable to said elongate support member for fastening said sleeve to said elongate support member.

7. A lighted extension attachment for tools as described in claim 1, wherein said tool members include a sander/sponge, a putty knife/scraper, a hook, a brush, and a paint roller, each of said tool member having a shaft which has a bore extending therein through an open end thereof, said shaft being adapted to be removably threaded upon said threaded top end portion of said elongate support member.

8. A lighted extension attachment for tools comprising:

a base member having a bore centrally-disposed therethrough;

an elongate support member having a bottom end and a top end portion and a bore extending therein and being removably supported in said bore of said base member;

a light-emitting assembly including a light socket member being fastenably attached to said elongate support member; and tool members being detachably attached to said elongate support member;

wherein said base member has an elongate slot extending in a bottom thereof and extending through a side thereof and extending into said bore of said base member;

wherein said top end portion of said elongate support member is annular recessed and is threaded;

wherein said elongate support member also includes a hole being disposed through a wall and into said bore near said top end portion thereof, said bore of said elongate support member extending from said hole through said bottom end thereof;

wherein said light emitting assembly also includes a sleeve being removably and fastenably mounted about said elongate support member;

wherein said light socket member includes an elongate housing having an open first end and an open second end and a bore extending therethrough, said elongate housing being securely attached to and angled from said sleeve:

wherein said light-emitting assembly further includes a fastening member being threaded through a hole in said sleeve and being engagable to said elongate support member for fastening said sleeve to said elongate support member;

wherein said light-emitting assembly also includes a light-emitting member being removably connected to said light socket member through said open first end and in said bore of said elongate housing, said light-emitting assembly further including a power cord being connected to said light socket member and being disposed through said bore of said elongate support member and in said elongate slot of said base member, said light-emitting assembly also including a protective cover being connected to said elongate housing and being disposed about said light-emitting member to prevent breakage of said light-emitting member.

9. A lighted extension attachment for tools as described in claim 8, wherein said tool members include a sander/sponge, a putty knife/scraper, a hook, a brush, and a paint roller, each of said tool member having a shaft which has a bore extending therein through an open end thereof, said shaft being adapted to be removably threaded upon said threaded top end portion of said elongate support member.

10. A lighted extension attachment for tools comprising:

a base member having a bore centrally-disposed therethrough, said base member having an elongate slot extending in a bottom thereof and extending through a side thereof and extending into said bore of said base member;

an elongate support member having a bottom end and a top end portion and a bore extending therein and being removably supported in said bore of said base member, said top end portion of said elongate support member being annular recessed and being threaded, said elongate support member also including a hole being disposed through a wall and into said bore near said top end portion thereof, said bore of said elongate support member extending from said hole through said bottom end thereof, said elongate support member having a length of approximately 48 inches;

a light-emitting assembly including a light socket member being fastenably attached to said elongate support member, said light-emitting assembly also including a sleeve being removably and fastenably mounted about said elongate support member, said light socket member including an elongate housing having an open first end and an open second end and a bore extending therethrough, said elongate housing being securely attached to and angled from said sleeve, said light-emitting assembly further including a fastening member being threaded through a hole of said sleeve and being engagable to said elongate support member for fastening said sleeve to said elongate support member, said light-emitting assembly also including a light-emitting member being removably connected to said light socket member through said open first end and in said bore of said elongate housing, said light-emitting assembly further including a power cord being connected to said light socket member and being disposed through said bore of said elongate support member and in said elongate slot of said base member, said light-emitting assembly also including a protective cover being connected to said elongate housing and being disposed about said light-emitting member to prevent breakage of said light-emitting member; and tool members being detachably attached to said elongate support member said tool members including a sander/sponge, a putty knife/scraper, a hook, a brush, and a paint roller, each of said tool member having a shaft which has a bore extending therein through an open end thereof, said shaft being adapted to be removably threaded upon said threaded top end portion of said elongate support member.

* * * * *